United States Patent [19]

Barton

[11] 4,345,709

[45] Aug. 24, 1982

[54] PAPER SPLICING DEVICE, ESPECIALLY FOR CIGARETTE OR FILTER ROD-MAKING MACHINES

[75] Inventor: Ronald S. C. Barton, Welling, England

[73] Assignee: Molins, Ltd., London, England

[21] Appl. No.: 152,845

[22] Filed: May 23, 1980

[30] Foreign Application Priority Data

May 29, 1979 [GB] United Kingdom ..... 7918676

[51] Int. Cl.[3] ..... B65H 23/08; B65H 17/32

[52] U.S. Cl. ..... 226/195; 226/95; 242/182

[58] Field of Search ..... 226/95, 195, 97; 242/58.1–58.3, 182, 183

[56] References Cited

U.S. PATENT DOCUMENTS

| | | | |
|---|---|---|---|
| 3,738,587 | 6/1973 | Cristiani | 242/58.1 |
| 3,754,723 | 8/1973 | Meyer | 242/182 X |
| 4,113,197 | 9/1978 | Harrington et al. | 242/58.1 |

*Primary Examiner*—Leonard D. Christian

*Attorney, Agent, or Firm*—Craig and Antonelli

[57] ABSTRACT

A web splicing device for a cigarette making machine, includes a reservoir in which web is accumulated prior to splicing, and a suction brake acting on the web after it leaves the reservoir so as to tension the web, characterized in that there is an auxiliary suction brake, upstream of the first-mentioned suction brake, having a guide which during normal operation holds the web away from the auxiliary suction brake in view of the tension in the web, but allows the web to engage the auxiliary suction brake when the tension falls as a result of web being accumulated in the reservoir in preparation for splicing or for any other reason.

14 Claims, 2 Drawing Figures

PAPER SPLICING DEVICE, ESPECIALLY FOR CIGARETTE OR FILTER ROD-MAKING MACHINES

This invention is concerned with an improvement in the type of paper web splicing device described in our British Pat. No. 1,086,065. Such devices have been used in the Molins Mark 9 cigarette making machines.

In splicing devices of this kind the paper web passes through a reservoir without normally accumulating in the reservoir. When a splice is to be made, the feed rate into the reservoir is temporarily increased to accumulate web in the reservoir. When sufficient web has been accumulated, the delivery into the reservoir can be stopped, allowing splicing to take place on stationary webs, while web is continued to be drawn from the reservoir.

After leaving the reservoir, the paper normally passes through a printing device by which a mark is made at regular intervals, e.g. indicating the name of the cigarette brand. It is desirable to ensure that the mark appears on each cigarette at exactly the same position. We have found, however, that a loss of paper tension downstream of the reservoir occurs while the reservoir is being filled, and this loss of tension can cause "print wander". The present invention is concerned particularly with maintaining the paper tension downstream of the reservoir to avoid this problem.

According to this invention, in addition to the suction brake which is normally provided downstream of the reservoir to tension the paper web, there is an auxiliary suction brake upstream of the first-mentioned suction brake; and this auxiliary suction brake has associated with it a guide which, during normal operation (i.e. while the web feed rates into and out of the reservoir are equal) holds the web away from the auxiliary suction brake in view of the tension in the web, but allows the web to engage the auxiliary suction brake when the tension falls as a result of web being accumulated in the reservoir in preparation for splicing or for any other reason. The auxiliary brake compensates for the reduction in the braking force applied by the main brake while web is being accumulated in the reservoir.

The auxiliary suction brake may conveniently be mounted in the reservoir. The guide associated with it may comprise the lip which has previously been included in the reservoir to engage the web and prevent a complete loop of paper being drawn out of the reservoir, i.e. after the reservoir has been filled. This lip corresponds to the strip 61 shown in the above-mentioned patent specification.

Figure 1:
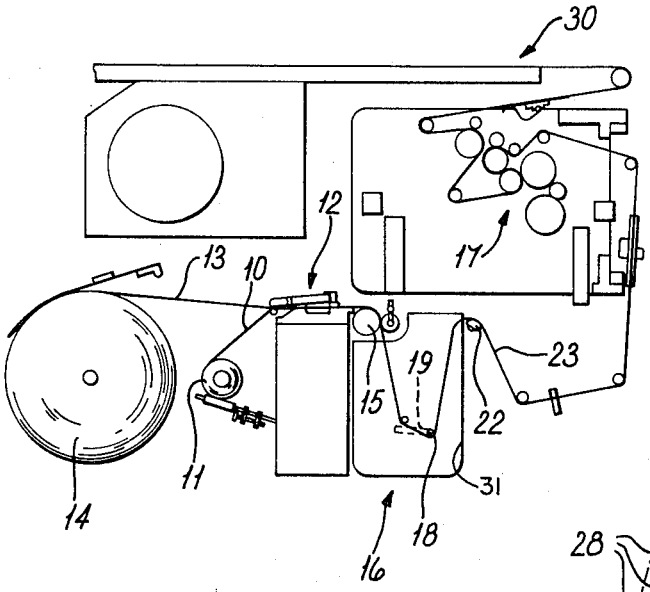
Figure 2:
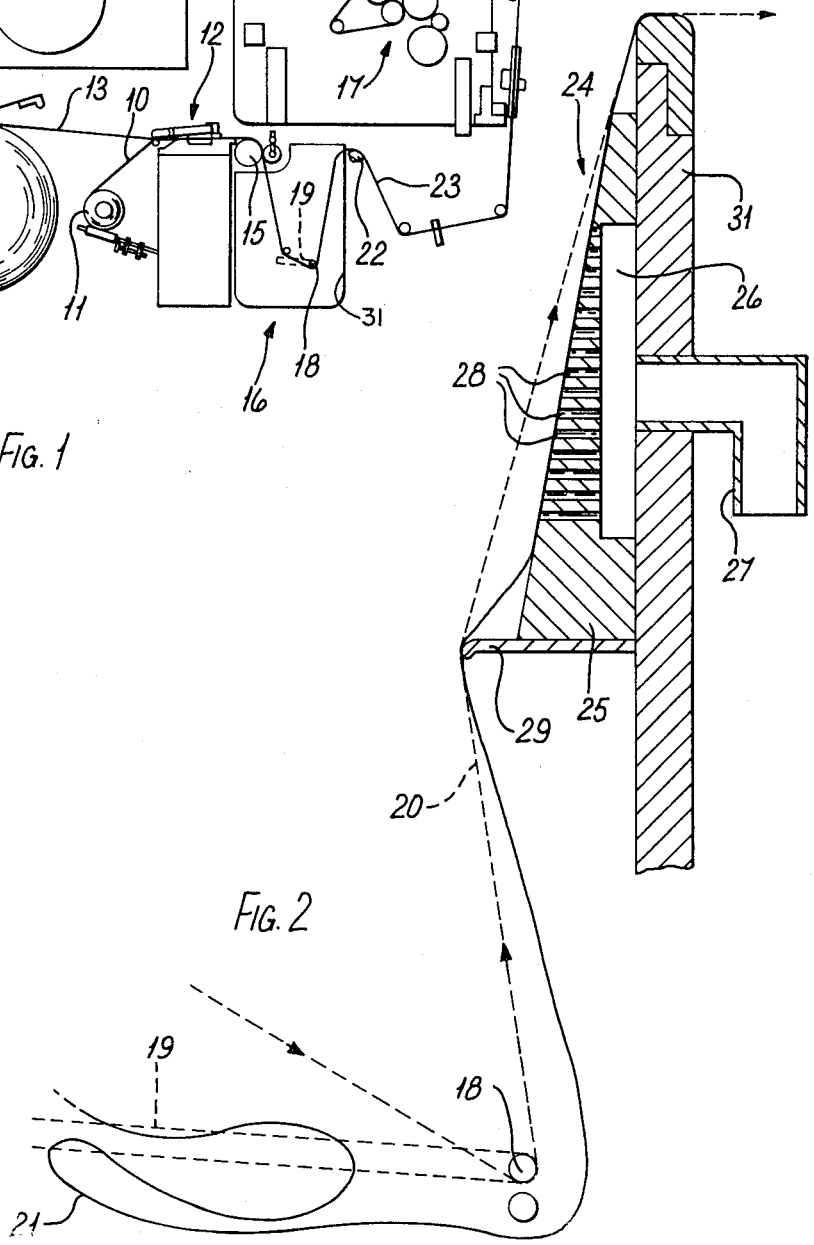

An example of a splicing device according to this invention is shown in the accompanying drawings. In these drawings:

FIG. 1 is an overall view of the well-known Molins splicing device together with the printer; and FIG. 2 shows how the reservoir of the splicing device shown in FIG. 1 is modified in accordance with this invention.

FIG. 1 shows a splicing device which is generally similar to that described in the above-mentioned patent specification. Paper web 10 is drawn from the in-use reel 11 past a device 12 which joins the trailing end of the paper to the leading end of a web 13 from a fresh reel 14 when the reel 11 is about to expire. In order to prepare for splicing, a feed roller 15 is speeded up so as to feed web into a reservoir 16 at a speed significantly greater than the speed at which the web is drawn from the reservoir by a printing device 17.

As described in the above-mentioned patent specification, the speed of the roller 15 is finely adjusted during normal running, in response to upward and downward movement of a pin 18 on a sensing arm 19, so as to equalise the feed rates into and out of the reservoir. During such normal running, the web 20 in the reservoir moves along the path shown by the broken line in FIG. 2. When the roller 15 is speeded up to accumulate web in the reservoir, the web drops below the pin 18 and forms folds in the reservoir, as shown by the continuous line 21.

On leaving the reservoir, the web passes around a suction brake 22 in the form of a convex pad with suction ports whereby the paper is gripped. As a result of the suction grip, the web leaving the brake 22 is in tension; the amount of tension remains substantially constant as long as the web is in tension in the reservoir, i.e. as during normal running. However, when tension is lost in the reservoir, the reaction of the web on the brake 22 has hitherto reduced substantially, thus reducing the frictional force of the brake 22 on the web.

In accordance with the present invention, an auxiliary suction brake 24 is included in the reservoir. This brake comprises a body 25 forming a chamber 26 which is connected to a suction pipe 27 and is connected via numerous passageways 28 to the outer surface of the body 25. A strip 29 forms a guide for the web which holds the web away from the surface of the body 25 when the web is in tension, as shown by the broken line. As soon as tension is lost in the reservoir, the web is sucked against the surface of the body 25, thus restoring the tension to the web as it leaves the reservoir.

The suction pressure in the auxiliary suction brake 22 (and possibly also in the main suction brake) is preferably adjustable. For example, the two brakes may be connected to a common suction source, and each may have an adjustable vent to atmosphere to control the suction existing in the brake itself.

It will be understood that, when web is accumulated in the reservoir, the part of the web adjacent to the auxiliary brake is readily against the brake since the thickness of the reservoir (at a right-angle to the drawing) is only slightly greater than the width of the paper web.

It should be noted that the auxiliary brake 24 is mounted on a wall 31 of the reservoir across which the web moves as it leaves the reservoir.

After passing through the printing device 17, the paper web is pulled through a garniture 30 in which it is wrapped around a cigarette filler stream to form a continuous cigarette rod in the usual manner.

We claim:

1. In A web splicing device for a cigarette making machine, including a reservoir in which web is accumulated prior to splicing and a suction brake acting on the web after it leaves the reservoir so as to tension the web, the improvement comprising an auxiliary suction brake, positioned upstream of the first-mentioned suction brake, including guide means which during normal operation holds the web away from the auxiliary suction brake in view of the tension in the web, but allows the web to engage the auxiliary suction brake when the tension falls as a result of web being accumulated in the reservoir in preparation for splicing or for any other reason.

2. A web splicing device according to claim 1 in which the auxiliary suction brake is mounted in the reservoir.

3. A web splicing device according to claim 2 in which the guide comprises a lip which also serves to prevent a complete loop of paper being drawn from the reservoir after the reservoir has been filled.

4. A web splicing device according to claim 1, 2 or 3 in which the auxiliary brake is mounted on or adjacent to a wall of the reservoir across which the web moves as it leaves the reservoir.

5. A web splicing device according to claim 1 including means for controlling the rate at which web is driven into the reservoir whereby, during normal operation, web enters the reservoir at the same rate as it leaves the reservoir so that the web in the reservoir is kept under tension.

6. A web splicing device according to claim 5 in which the control means comprises movably mounted guide means in the reservoir around which the web is arranged to pass, and means for drawing the web into the reservoir at a speed dependent upon the position of the said guide means in the reservoir.

7. A web splicing device according to claim 1 in which the web is drawn from the reservoir by a web printing device.

8. A web splicing device for splicing the leading end of a first web provided by a first web supply to the trailing end of a second web which is being drawn through said web splicing device by a web receiving apparatus, said web splicing device comprising:

a reservoir through which said second web is drawn by said web receiving apparatus;

a suction brake acting on said second web after it leaves said reservoir so as to tension said second web by a predetermined amount;

drive means for supplying said second web to said reservoir at a rate greater than the rate at which said second web is withdrawn therefrom in preparation for splicing, thereby to accumulate said second web in said reservoir;

splicing means upstream of said reservoir for splicing the leading end of said first web to the trailing end of said second web; and an auxiliary suction brake, positioned upstream of said first-mentioned suction brake and responsive to said drive means accumulating said second web in said reservoir, for engaging said second web to maintain said predetermined amount of tension on said second web as it leaves said reservoir.

9. A web splicing device according to claim 8, wherein said drive means includes means for controlling the rate at which said second web is supplied to said reservoir whereby, during times other than those at which preparation for splicing and splicing operations occur, said second web enters said reservoir at the same rate as it leaves said reservoir so that the web in the reservoir is kept under tension.

10. A web splicing device according to claim 9, including a guide which engages said second web so as to maintain said second web out of engagement with said auxiliary brake while said web is under tension in said reservoir.

11. A web splicing device according to claims 8 or 10, in which the auxiliary brake is mounted on or adjacent to a wall of the reservoir across which the web moves as it leaves the reservoir.

12. A web splicing device for splicing the leading end of a first web provided by a first web supply to the trailing end of a second web which is being drawn through said web splicing device by a web receiving apparatus, said web splicing device comprising:

a reservoir through which said second web is drawn by said web receiving apparatus;

a suction brake acting on said second web after it leaves said reservoir so as to tension said second web by a predetermined amount;

drive means for supplying said second web to said reservoir at a rate greater than the rate at which said second web is withdrawn therefrom in preparation for splicing, thereby to accumulate said second web in said reservoir;

splicing means upstream of said reservoir for splicing the leading end of said first web to the trailing end of said second web; and means responsive to said drive means accumulating said second web in said reservoir for increasing the braking effect on said second web beyond that which would normally be provided by said suction brake at that time so as to maintain said predetermined amount of tension on said second web substantially constant at all times.

13. A web splicing device according to claim 12, wherein said drive means includes means for controlling the rate at which said second web is supplied to said reservoir whereby, during times other than those at which preparation for splicing and splicing operations occur, said second web enters said reservoir at the same rate as it leaves said reservoir so that the web in the reservoir is kept under tension.

14. A web splicing device according to claim 12, wherein said means for increasing the braking effect on said second web is an auxiliary suction brake positioned upstream of said first-mentioned suction brake.

* * * * *